US005347788A

United States Patent [19]

Petz et al.

[11] Patent Number: 5,347,788

[45] Date of Patent: Sep. 20, 1994

[54] APPARATUS FOR ADJUSTING THE HOLDING CAPACITY OF A WORKPIECE CARRIER

[75] Inventors: Georg Petz, Griesheim; Frank Heidenblut, Darmstadt, both of Fed. Rep. of Germany

[73] Assignee: Tetra Alfa Holdings S.A., Pully, Switzerland

[21] Appl. No.: 976,165

[22] Filed: Nov. 10, 1992

[30] Foreign Application Priority Data

Nov. 12, 1991 [DE] Fed. Rep. of Germany ..... 4137098

[51] Int. Cl.[5] ..... B65B 43/42; B65B 51/00; B31B 1/00; B65G 17/36

[52] U.S. Cl. ..... 53/282; 53/201; 53/257; 198/803.11

[58] Field of Search ..... 53/282, 201, 257, 167, 53/271; 198/740, 738, 803.11

[56] References Cited

U.S. PATENT DOCUMENTS

| | | | |
|---|---|---|---|
| 1,705,063 | 3/1929 | Mitchell | 53/257 |
| 2,933,869 | 4/1960 | Meyer-Jagenberg | 53/201 |
| 3,090,478 | 5/1963 | Stanley | 198/803.11 X |
| 3,252,267 | 5/1966 | Myles et al. | 53/201 X |
| 3,998,030 | 12/1976 | Straub | 53/282 X |
| 4,807,421 | 2/1989 | Araki et al. | 53/282 X |
| 4,979,347 | 12/1990 | Shibauchi et al. | 53/282 X |
| 5,123,227 | 6/1992 | Shibauchi et al. | 53/201 |

FOREIGN PATENT DOCUMENTS

| | | |
|---|---|---|
| 1810683 | 6/1959 | Fed. Rep. of Germany . |
| 7907785 | 8/1979 | Fed. Rep. of Germany . |
| 8003402 | 6/1980 | Fed. Rep. of Germany . |
| 3709267 | 9/1988 | Fed. Rep. of Germany . |
| 4001051 | 7/1991 | Fed. Rep. of Germany . |

OTHER PUBLICATIONS

EPO Search Report, EP92 117669, Mar. 10, 1993 (Fax Copy & Cover Sheet).

*Primary Examiner*—James F. Coan
*Attorney, Agent, or Firm*—Paul & Paul

[57] ABSTRACT

An apparatus is described for the adjustment of the holding capacity of a package carrier (3) supported on a line (1) and which comprises at least one externally plane side wall (4) which is closest to the line (1) and which extends parallel with this latter and with the direction of conveyance of the package carrier (3), there being on the inner surface of the package carrier (3) recesses (5) for positioning of the package. In order to improve such an apparatus so that the packages are better supported and so that adjustment of the volume is possible by even simpler means at virtually any location on the conveyor, it is according to the invention proposed that the recesses (5) on the inner surface of the package carrier (3) be spaced apart in relation to one another in the direction of its longitudinal central axis (6) and in that the package carrier (3) have the form of a sleeve open at both ends and in that an abutment member (9) should be provided which is adapted for movement in relation to the package carrier (3).

18 Claims, 14 Drawing Sheets

APPARATUS FOR ADJUSTING THE HOLDING CAPACITY OF A WORKPIECE CARRIER

The invention relates to an apparatus for adjusting the holding capacity of a workpiece carrier supported on a line and which has at least one outwardly substantially plane side wall which is closest to the line and which extends parallel therewith and with the direction of conveyance of the workpiece carrier, there being provided on the inner surface of the workpiece carrier recesses for positioning of the workpiece.

For transporting workpieces, all manner of conveying means are known, this text referring to those conveyors in which the workpiece is held on and is transported by a carrier supported on the conveyor line. For example and preferably, packages to hold liquids are envisaged which are it is true also transported directly on conveyor belts without a carrier although handling them, particularly filling and sealing them, means that it is preferable to dispose them in a workpiece carrier; even for positioning purposes, this is preferable.

Various sizes of package are known. For example, spirits, wine and juices are transported in relatively small packages, to a certain extent juices, milk, oils and water are transported in larger packages. The rough classification indicated here is intended purely to show that packages for liquids—and of course also for other contents—of different volumes need to be filled and used. For the manufacturer and user of an apparatus of the type mentioned at the outset, it is desirable to produce workpieces, e.g. liquids packages of paper, having different capacities on one and the same production machine after a few minor adjustments. If a part of the production machine is a conveyor with a line on which workpiece carriers are fitted, then it should be possible to change the workpiece carrier from a large capacity workpiece to one which is of smaller capacity.

In the case of conveyor means, it is already known for such an adjustability of the holding capacity of workpiece carriers to incorporate lifting rails along the conveyor path, in which case then, for a constant cross-section, the workpiece carrier is at maximum depth without the lifting rail so that it has maximum capacity; when the lifting rail is installed and can be adjusted for example for a shorter package, the bottom of this shorter package can be brought to such a height by the lifting rail in the tool carrier that the top edges of workpiece carrier and workpiece is the same for all volumes. It is true that such a lifting, rail is adjustable but in curved portions of a conveyor it cannot be used without some disadvantage. Furthermore, practical experience has shown that for three different capacities, for example three different lifting rails have to be used.

Furthermore, working practice has shown that with some processing station in the production machine, a workpiece carrier has to be lifted, lowered and returned to its original position in relation to the level of delivery. When using the lifting rails, such raising or lowering from the zero level can be achieved only at considerable expense.

It has also been proposed, for adjusting the holding capacity of the workpiece carrier, to displace its bottom plate in a vertical direction. For this purpose, thrust rods with guide plates adapted for rectilinear and translatory movement and engaging over the line in their extension transversely to the direction of conveyance of the workpiece carrier were provided. An essential condition thereby was to have specially constructed workpiece carriers with pairwise oppositely disposed parallel straight grooves in which the relevant bottom plate could be pushed into or withdrawn from them from without, by means of the guide plates. This in-house apparatus, operated under test conditions, is worthy of improvement.

The object of the present invention therefore is so to improve the apparatus of the type mentioned at the outset that the workpieces are better supported and so that adjustment of the capacity is possible by even simpler means at virtually any location along a conveyor.

According to the invention, this problem is resolved in that the recesses on the inner surface of the workpiece carrier are so disposed at a distance from one another in the direction of its longitudinal central axis that the workpiece carrier takes the form of a sleeve open at both ends and in that an abutment member is provided which is adapted for movement in relation to the workpiece carrier. Disposed on the inner surface of the workpiece carrier, at various locations, are recesses with which one or a plurality of abutment members can engage. Such an abutment member may for example be a bottom plate, a pin or the like, the function of the abutment being important in that in fact the workpiece in the workpiece carrier approaches a specific abutment. It must be understood that upon deeper insertion of the workpiece into the carrier, larger workpieces or those of greater volume can be received and transported; and conversely upon insertion by only a shorter distance into the workpiece, only workpieces of smaller volume can be carried, received, conveyed and possibly machined. By disposing these abutment members at various locations in respect of the longitudinal central axis of the workpiece carrier, therefore, adjustment of the holding capacity of the workpiece carrier is achieved by very simple means. The recesses may be slots, grooves, holes of all manner of shapes. A further advantage is the form of the workpiece carrier, namely a sleeve open at both ends. Because the present invention is suitable particularly when transporting and supporting flowable media packages of coated paper or cardboard, the advantages of the various embodiments are described in connection with such packages. Any desired sleeve-like workpieces and in particular such packages are of sleeve-shape at certain stages in their manufacture. By reason of the similar geometry of the workpiece and of its carrier, there is obviously a satisfactory supporting of the workpiece in the carrier. In fact in the case of the previously described in-house testing of workpiece carriers, it has been demonstrated that the ready accessibility of recesses from outside so that for example bottom plates can be pushed into grooves in the workpiece carrier from outside, requires the provision of large open areas on the side walls of the workpiece carrier. Thus, it was possible to rotate the package and even tilt it, because the carrier was laterally open at the bottom. Due to the sleeve-shape of the workpiece carrier provided according to the invention, neither rotation nor tilting of the workpiece and in particular of an empty or filled package is possible. The workpiece is securely supported and nevertheless it is possible for abutment members so to move from outside into the interior of the workpiece carrier that the package pushed in in the direction of the longitudinal central axis of the workpiece carrier engages the abutment at the desired height.

It is particularly preferable if according to the invention and in accordance with a very favourable embodiment, the abutment member is a bottom plate, the edges of which can be brought into engagement with the recesses on the workpiece carrier. The bottom plate is via a slot disposed at a specific height in relation to the longitudinal central axis of the workpiece carrier, pushed in from outside and can be readjusted to another position by being moved out of this special position by being withdrawn, reversed in the direction of the longitudinal central axis of the carrier and reinsertion at some other location with similar recesses. Thus, the holding capacity of the workpiece carrier is adjusted.

For easier comprehension of the ideas according to the invention, it should be imagined that the sleeve-like workpiece carrier is set up vertically so that its longitudinal central axis extends vertically. The difference in height for different holding capacities of the workpiece carrier therefore means the disposition of an abutment member, e.g. a bottom plate, vertically above, vertically in the centre or (after vertical adjustment) down in the bottom part of the workpiece carrier. Furthermore, the premise is adopted that the workpiece, preferably the package to be machined, is introduced from above through the free end of the workpiece carrier and is pushed downwardly sufficiently in a vertical direction that the bottom of the preferably open topped package moves downwards onto the abutment member, preferably the bottom plate, and is supported there.

For easier understanding, the words "vertical" and "horizontal" are used hereinafter and it is understood by the foregoing definition that the longitudinal central axis of the workpiece carrier is vertical. Setting the abutment member at various heights takes place once the abutment member has been completely disengaged from the workpiece carrier in a vertical direction namely parallel with the longitudinal central axis. Of importance to the invention is not only the direction of the displacement but also the movement of the abutment member into or out of the interior of the workpiece carrier and a man skilled in the art, when using a bottom plate as an abutment member, can readily imagine that insertion of the bottom plate takes place in a horizontal direction, which within the meaning of the invention means nothing other than at right-angles to the longitudinal central axis through the workpiece carrier; and .furthermore also at right-angles to the direction of conveyance of the line on which the conveying member is seated and to which the workpiece carrier is connected.

According to the invention, then, it is important to differentiate between two main groups, namely the horizontal group and the vertical group. The horizontal group is so named because in it the abutment members are moved in the aforementioned horizontal direction in relation to the workpiece carrier. The vertical group is so named because with regard to it embodiments are described in which abutment members, such as for example the bottom plate, are moved vertically into or out of the interior of the workpiece carrier. There is an obvious advantage in the shape which according to the invention is chosen for the workpiece carrier, namely the sleeve which is open at both ends. The package or workpiece is pushed in at one, preferably the upper, end. In the case of the vertical solution, the abutment member, preferably the bottom plate, can be introduced from the other end, for example from the bottom upwardly and vice versa, into the interior of the workpiece carrier, or may conversely be extracted therefrom.

The aforementioned features were common to both groups.

The following relates to the horizontal group, i.e. to a horizontal direction of movement of the abutment members.

According to the invention, such an embodiment is particularly advantageously characterised in that the abutment member is adapted for movement with at least a movement component at right-angles to the direction of conveyance of the workpiece carrier and at right-angles to its longitudinal central axis in relation to the workpiece carrier through which it partially penetrates. Here a preferred embodiment is characterised in that the recesses are constructed as straight parallel grooves disposed opposite one another in pairs, in which the bottom plate is loosely displaceable by an adjusting device disposed at a distance from and adjacent the line with the workpiece carriers. Chosen here as an embodiment of the abutment part is the bottom plate. It is loosely displaceable in the slots described and can by reason of the already above-mentioned slot in a side wall of the workpiece carrier, be inserted horizontally into this slot from outside and also with-drawn from it in order to be moved. This movement operation is undertaken by an adjusting device which is so disposed at a distance from and adjacent to the line that the workpiece carriers pass through between the line and the adjusting means. The result is short paths and minimal working times. Furthermore, the adjusting device may be of simple construction as is demonstrated by the following descriptions of examples of embodiment.

In the case of the solution involving the line described, it is possible to double the capacity of the machine in that the same means and machine parts can be provided on *both* sides of the line so that with one and the same line of conveying members in each case two workpiece carriers can be transported and correspondingly converted.

It is preferable in this case if according to the invention the adjusting means comprises a lifting member for moving a gripper system which is adapted to be connected to the bottom plate in a direction parallel with the longitudinal central axis through the workpiece carrier and a sliding member adapted to be moved preferably by the lifting member and for moving the gripper system transversely to the longitudinal central axis of the workpiece carrier and transversely to its direction of conveyance.

An adjusting device which is constructed in this way subdivides the movement of the abutment member into the previously defined vertical movement on the one hand and the horizontal movement on the other. The lifting member provides for a vertical movement and the sliding member provides for the horizontal movement. The sliding member is carried by the lifting member and can be moved upwards and downwards into the desired position parallel with the longitudinal central axis through the workpiece carrier. When this position is reached, then the sliding member is actuated and moves the gripper system up to the abutment member which is still disposed in the workpiece carrier, withdraws it, is once again set in motion by the lifting member and after the movement of the lifting member has stopped, pushes it horizontally in another position back into the workpiece carrier so that the holding capacity of the carrier has been adjusted very rapidly.

Another and likewise very favourable embodiment of the invention is characterised in that the abutment member is constructed as a switching pin adapted for insertion into and withdrawal from the interior of the workpiece carrier and in that at least two switching pins are provided and are displaceable by means of control members. In the case of this embodiment, no, bottom plate is used. Many workpieces can be so inserted with a certain friction into a carrier that when the thrust force is ended, they more or less remain at the desired position. However, in order to have the position of the workpiece or of the passage even more precise, the package ought to encounter an abutment member, in the present case for example a switching pin. The volume of the workpiece carrier is then precisely adjusted. In this embodiment, the recesses on the inside face of the workpiece carrier are holes which completely traverse the relevant workpiece walls. It is expedient to provide at least two spaced-apart holes and thus also switching pins, so that abutments for the pushed-in package are provided at two different locations or at different heights in the workpiece carrier. A third position can for example be attained automatically if the bottom end of the workpiece carrier has at least partially a fixed abutment in the form of an edge or a bottom. It is true that the sleeve may still be open at this end and yet there is a fixed abutment there for all those cases where the workpiece carrier has to be adjusted to the maximum volume, in other words where the package is to be pushed through the entire carrier from above until it reaches the bottom end stop. In this case, then, both switching pins are so withdrawn from the holes in the workpiece carrier walls or side walls of the workpiece carrier that there is no travel when the workpieces or packages are pushed in and slide past.

In order to operate the switching pins in the simplest possible way, controlling bodies are provided. In the case of a preferred embodiment, it is particularly expedient if two separate control bodies are adapted for a reciprocating translatory movement independently of each other as the result of a .lifting member in the direction parallel with the longitudinal central axis of the workpiece carrier, in, each case carrying a control cam in which outer abutments of the switching pins are guided for a sliding movement. The outer abutment can for example be a head thereon constructed in one piece with the switching pin, as in the case of a screw head, but having an L-shape in the longitudinal section of the switching pin. All that is important is that the side flank of a controlled cam should co-operate with a part of the switching pin which extends in a so-called vertical direction in order to actuate it. Two separate control bodies are disposed vertically one above the other, whereby for better protection the control cams are towards each other but can with a corresponding lifting part be moved in a vertical direction separately from each other. By virtue of this movement, it is possible to provide for an engagement of the control cam with the switching pin or to avoid such a contact.

Where this embodiment is concerned, control of the switching pins is achieved virtually by the conveying movement of the line and thus the movement of the workpiece carrier itself This is in fact moved by the line in the second horizontal direction described and which extends at a right-angle to the horizontal displacement movement of the abutment member. The control cams likewise have an extension component in this second horizontal direction, as well as a component in the first horizontal direction for withdrawing or inserting the switching pins into or out of the workpiece carrier. If the workpiece carriers with the line move into the second horizontal position, then via the relevant control cam, when it has been brought into engagement with the switching pin, the switching pin is withdrawn or is pushed into the workpiece carrier. Controlling of the lifting member decides whether both or only one switching pin is or are used. The capacity of the workpiece carrier is therefore advantageously changed automatically by the onwards feeding of the line with the workpiece carriers, when the conversion is concluded, i.e. if again standard production operation is engaged, then all the switching pins will run without contact with the control cams and the control bodies. Photoelectric cell scanning ensures that the position of the relevant switching pin is recognised and that a control body or a control cam cannot approach and break off a falsely positioned switching pin. When the reversing process is switched on, the photoelectric cell signals are also used in order to ascertain that the switching pin is correctly positioned and to displace it to some other clearly defined position in order then to disengage the control body from the switching pin.

Hereinafter, embodiments from the second so-called vertical group are explained.

In this case, particularly important is the embodiment in which the bottom plate is used as an abutment part with the further characterising fact that the bottom plate can be moved in the interior of the workpiece carrier in the direction of its longitudinal central axis by an adjusting device which has a gripper system which can be connected to the bottom plate. In contrast to the above-described horizontal movement of the switching pins or bottom plate—also by means of suitably constructed gripper systems—in a surprisingly simple manner it is suggested that the bottom plate be moved vertically in this embodiment. The upper free end of the sleeve-shaped workpiece carrier is used for inserting or withdrawing the workpiece or the package and in this case the bottom free end of the sleeve-like workpiece carrier is used for adjusting the bottom plate within the workpiece carrier.

According to the invention, it is particularly expedient if at least two oppositely disposed edges of the bottom plate are of resiliently elastic construction and, in the normal relaxed position, are locked in corresponding recesses in the workpiece carrier. It is possible to conceive of grooves, holes, slots or other shapes of recesses being provided on the inner surface of the workpiece carrier, which can be brought into engagement with corresponding projections on the edges of the bottom plate. If these edges are of resiliently flexible construction, then after the appropriate rigid engagement into the bottom plate, this latter can be separated from the locked engagement by the application of force, pushed into the desired different height and locked afresh into the recess available, whereupon the gripper device can then be disengaged from the bottom plate. This is a surprisingly simple and very effective way of adjusting the holding capacity of the workpiece carrier.

It is thereby particularly advantageous for the gripper system to comprise a clamping head adapted to be brought into engagement with at least one hole in the bottom plate or a bifurcated member adapted for movement outside the workpiece carrier and which can be caused to engage pins mounted on the bottom plate. Here, two embodiments are described as alternatives:

the first consist of using a clamping head which brings clamping means so into engagement in at least one hole in the bottom plate that the bottom plate is rigidly connected to the clamping head. If this latter is then fixed on or becomes a part of the adjusting device, then by suitable lifting drives, it will be moved to and fro vertically so that the bottom plate can be moved in the desired way from one position into the other. The second embodiment consists of a bifurcated member adapted for vertical and horizontal movement outside the workpiece carrier and into which pins engage when the bifurcated member is moved horizontally towards the bottom plate. It will be understood that the pins can only be moved vertically with the help of the bifurcated member, precise vertical displacement in a fashion being permitted.

In the case of another preferred embodiment from the vertical group, it is according to the invention advantageous if the clamping head has at least two mutually opposite and radially inwardly pretensioned bar springs which extend substantially parallel with the longitudinal central axis through the workpiece carrier and can so engage resilient tongues formed on the edge of the bottom plate by slots that projections disposed on the outer edges of the tongues can be disengaged from recesses in the workpiece carrier by a reduction in the diameter of the bottom plate. By using the above-defined terms "vertical" and "horizontal", this embodiment with the clamping head denotes a displacement of the bottom plate vertically from one height to another in that, by travelling vertically, the aforesaid bar springs initially engage in peripherally disposed holes on the bottom plate and are so moved inwardly that the edge of the bottom plate becomes radially reduced. It will be understood that in consequence the edge of the bottom plate is disengaged from the inside surfaces of the workpiece carrier and consequently the bottom plate can then be displaced vertically. If after displacement the bottom plate has reached the new position, then the bar springs are moved outwardly, i.e. the outside diameter of the bottom plate is increased in its marginal zone, the edges of the bottom plate move into the oppositely disposed recesses in the side walls and the new position of the abutment member or of the bottom plate is achieved. Enlargement and reduction of the diameter of the bottom plate is possible by reason of the fact that it externally carries slots by which resilient tongues are formed in the region of the bottom plate. The spring direction of these tongues is radial, i.e. towards the centre of the bottom plate and in the opposite direction. If, then, the holes are disposed in these resilient tongues, then it can be appreciated that by radial adjustment of the bar springs the tongues are also open to radial displacement, which means that the outside diameter of the bottom plate can be altered.

However, there is another embodiment with a clamping head in which, according to the invention, the clamping head has a mandrel adapted to be brought into engagement with a central hole in the bottom plate. As such a mandrel, it is possible to use a rubber mandrel, as in the case of a beer bottle stopper, or even a flattened elongated end of a rod, e.g. a piston rod which moves in a vertical direction substantially in the region of the longitudinal central axis of the workpiece carrier, in fact in a translatory sense in a vertical direction for displacement of the bottom plate, but also rotatingly for turning the elongated flattened rod end in order in fact to guarantee clamping of the rod end together with the bottom plate. In this case, an elongated hole in the bottom plate is conceivable, through which the elongated flattened rod end can only pass when it is in one specific rotated position. If this is altered, for example by rotation through 90°, then by pulling back the flattened rod end it is possible to join this structure to the bottom plate in the same way as a mandrel. Also this is a simple and very effective development of a gripper system which is needed in order to ensure a firm grip with the locked bottom plate in order to move the bottom plate into another locking medium.

In the case of a further advantageous development of the invention, the cross-section of the workpiece carrier and the bottom plate are rectangular preferably with rounded corners, the adjusting means comprises a rotary cylinder and the recesses are so disposed on the plane inner surfaces of the workpiece carrier that after a relative rotation through about 45° they can be brought into a clamping engagement with the corners of the bottom plate. This embodiment is again convincing by reason of its simplicity, the rectangular outside dimensions of the bottom plate being such that they are somewhat smaller than the inside rectangular measurements of the cross-section of the workpiece carrier so that the bottom plate, while in its relative position, can still nevertheless be moved at right-angles to the longitudinal central axis through the workpiece carrier without friction and in a trouble-free manner and in the direction of its longitudinal central axis. Fixing with a clamping engagement between bottom plate and inner surface of the workpiece carrier is achieved by relative rotation of the two parts, preferably rotation of the bottom plate in relation to the workpiece carrier. For this movement, the rotary cylinder is provided, the construction of which is known and which is commercially available. Where this embodiment is concerned, the workpiece carrier has plane inner surfaces and oppositely disposed recesses are machined into these surfaces in such a way that to the most extreme degree the recesses are spaced apart in these oppositely disposed wall parts, the spacing being equal to the diagonal outer dimension across the corners of the bottom plate. Thus, after its vertical movement and rotation through 45°, the bottom plate can be brought into a clamping engagement.

The cross-section of the workpiece carrier may be variously formed, as has already been variously indicated. For example, for particular types of packaging, it is preferable for the cross-section of the workpiece carrier to be circular. This embodiment is particularly applicable when the above-described switching pins are used because also a circular package can be accurately adjusted by switching pins in a sleeve-like workpiece carrier which has a circular cross-section.

There are also intermediate solutions concerning the cross-sectional form of the workpiece carrier. For example, in the case of another embodiment according to the invention, it is particularly preferred for the cross-section of the workpiece carrier to consist of at least two oppositely disposed straight portions and, to connect these latter, rounded corners which consist of two semicircular or four quarter-circular rounded portions. Such workpiece carriers are particularly suitable for holding packages which are substantially rectangular in cross-section but the corners of which are rounded. Then in each case two pairs of oppositely disposed straight portions are connected by four quarter-circular rounded portions. If all these portions are juxtaposed, then for the cross-section of the workpiece carrier, the same shape is formed as the outer shape of the package to be held, which is why this latter fits very well into the workpiece carrier and can be precisely adjusted to the correct volume by means of the abutment members. It is readily conceivable that regardless of the cross-sectional form of the workpiece carrier on the inside, one side wall of the workpiece carrier can be externally flattened in order to connect this workpiece carrier to the conveyor line member via this plane outer surface.

According to the invention, it is furthermore advantageous if in two oppositely disposed side walls of the workpiece carrier there is an elongated hole extending parallel with the longitudinal central axis. In this case, it is an aperture which passes through the outer walls of the workpiece carrier and through which pins disposed on the bottom plate can extend outwardly from the interior of the workpiece carrier so that a gripper system provided with bifurcated members can engage over the outwardly projecting pins while the bottom plate is still inside the workpiece carrier. This gripper system with a bifurcated member and with pins mounted on the bottom plate has already been mentioned hereinabove. Specific embodiments will be described hereinafter.

Furthermore, it is particularly expedient to use one of the previously explained types of adjusting device for transporting tubular flowable media packages which are open at one end in a machine for producing and/or filling and/or sealing such packages. With i, many advantages can be achieved in the above-mentioned packaging machines, in some cases simultaneously, but which can only be achieved incompletely or in isolation, or which fail to be achieved at all by prior art conveying means, and the adjusting device is provided on such means.

Further advantages, features and possible applications of the present invention wi 11 emerge from the ensuing description of preferred examples of embodiment taken in conjunction with the appended drawings, in which.

Figure 7:
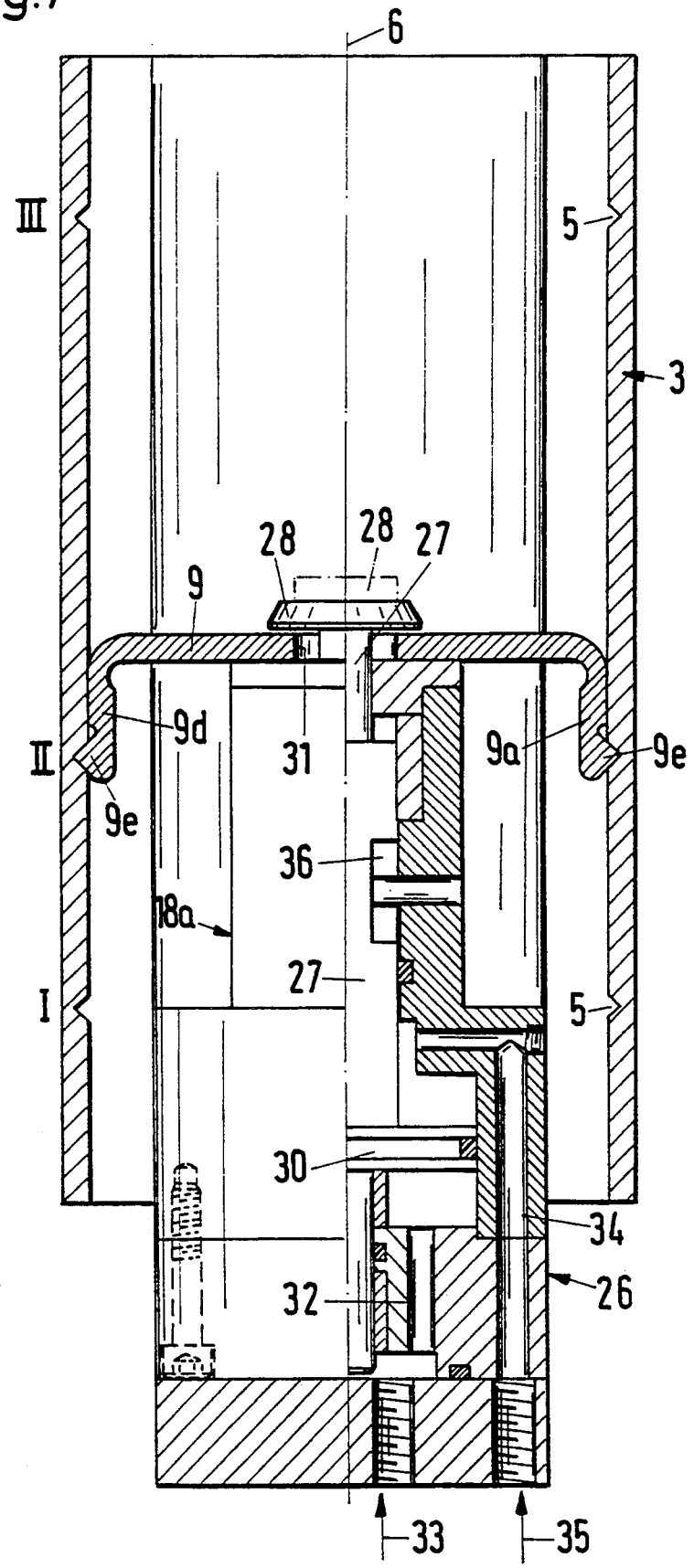
Figure 8:
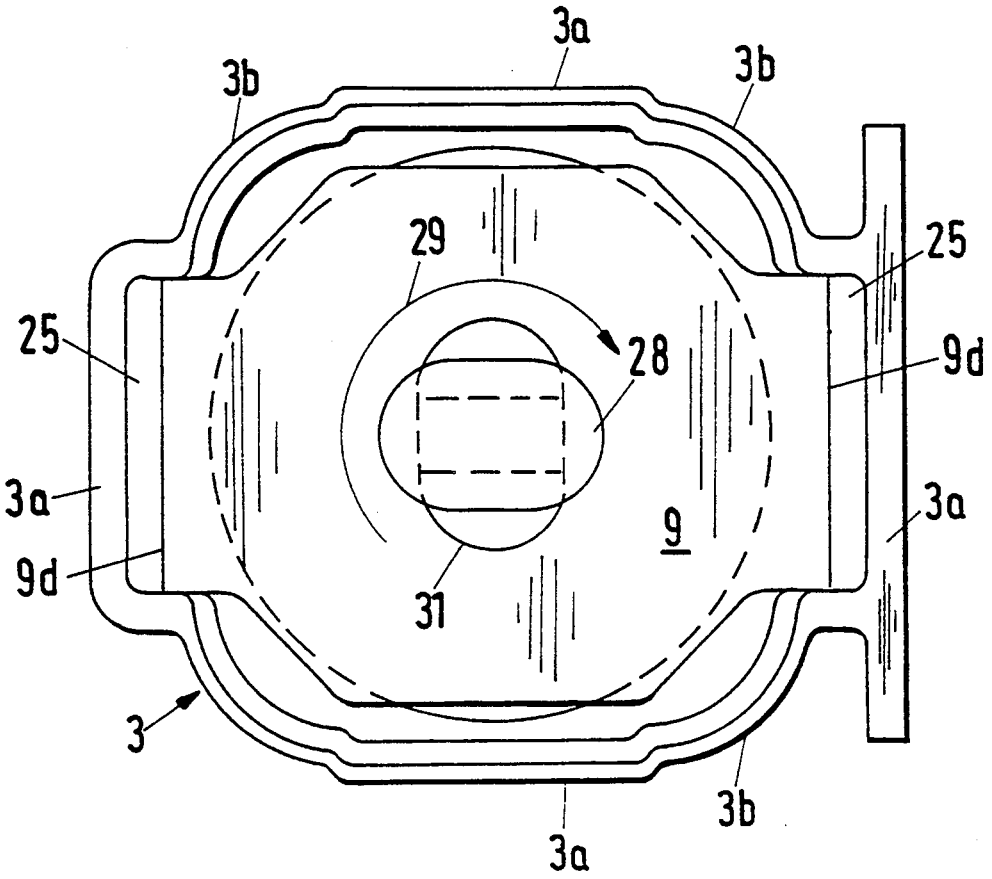
Figure 9:
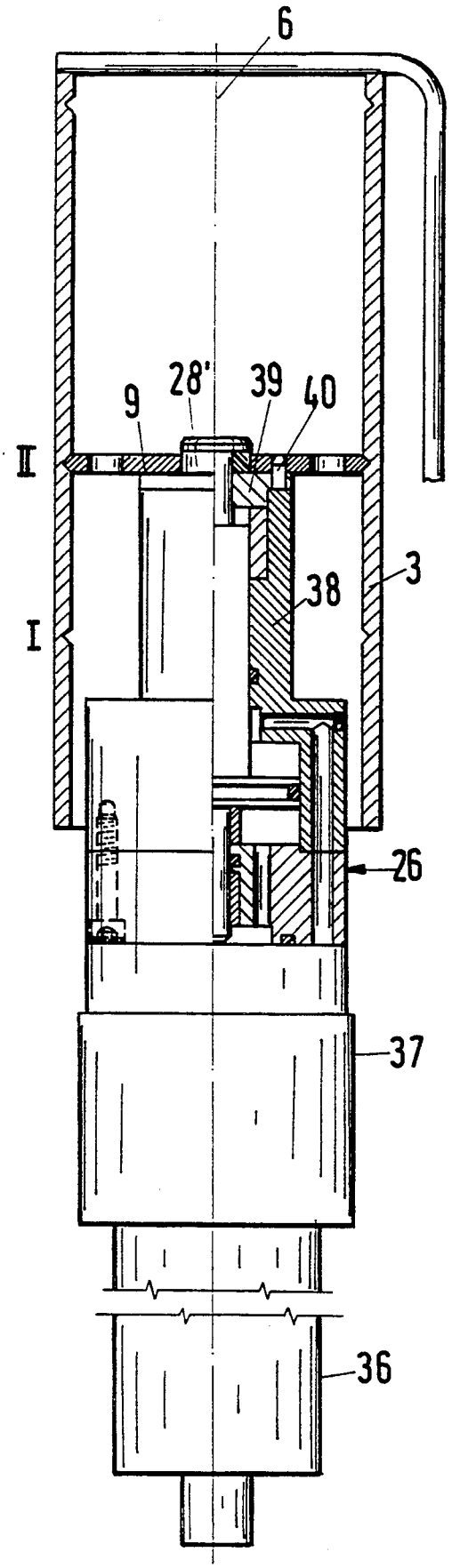
Figure 10:
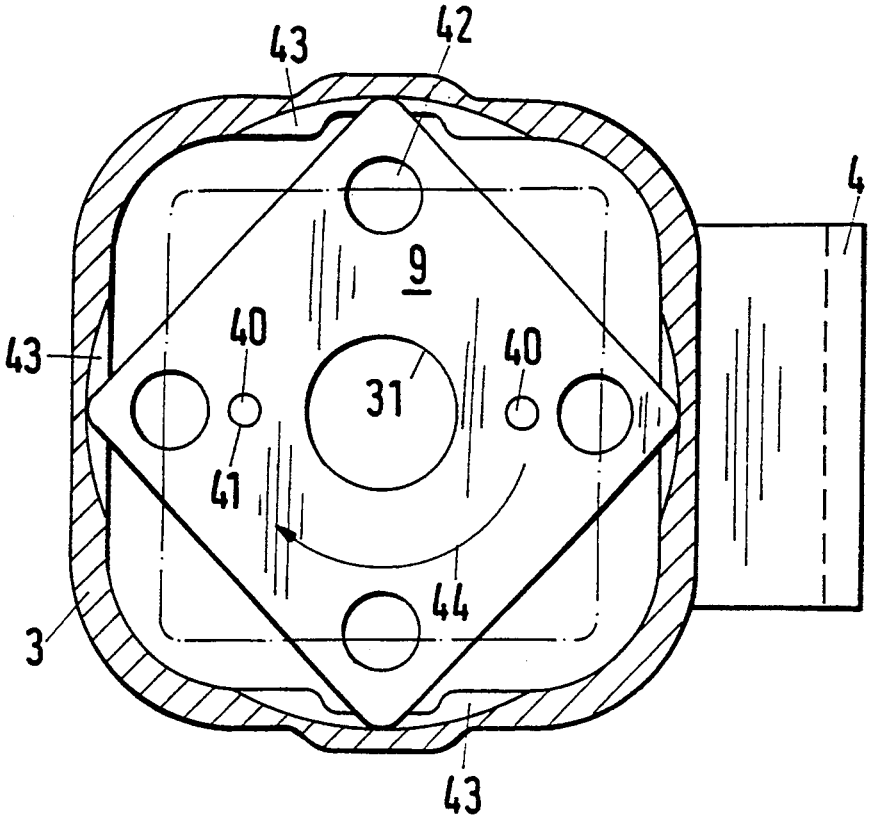
Figure 11:
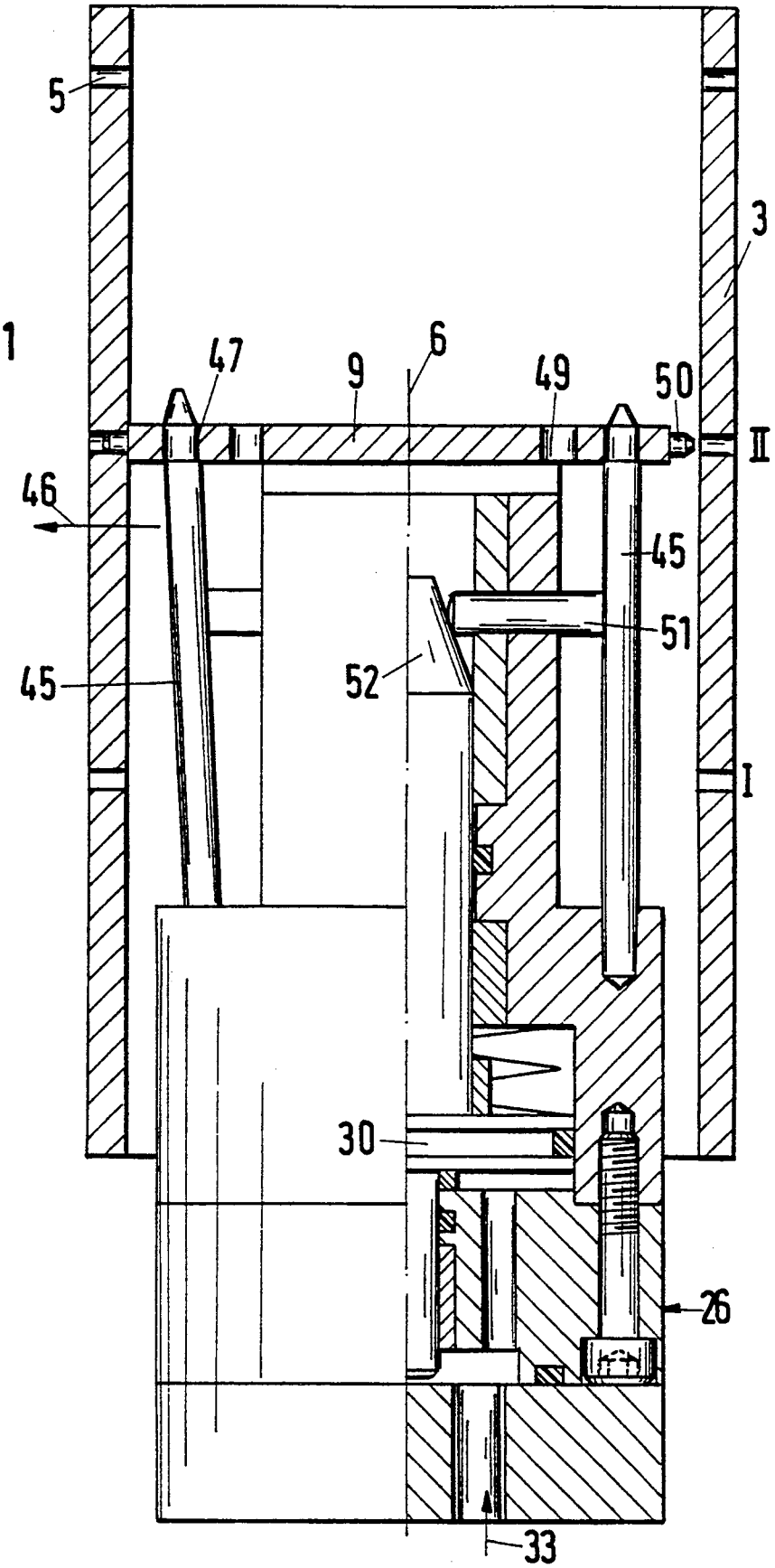
Figure 12:
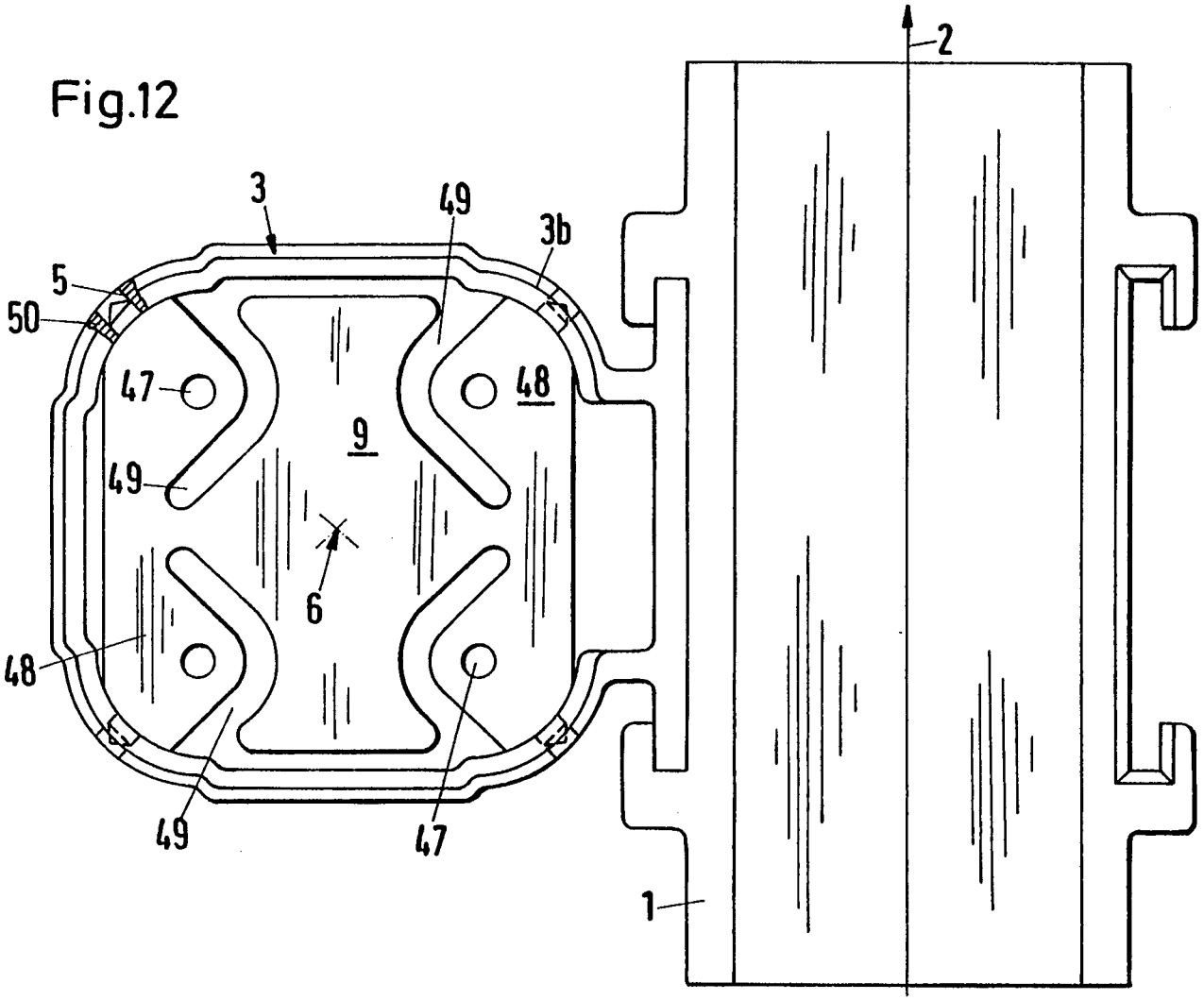
Figure 13:
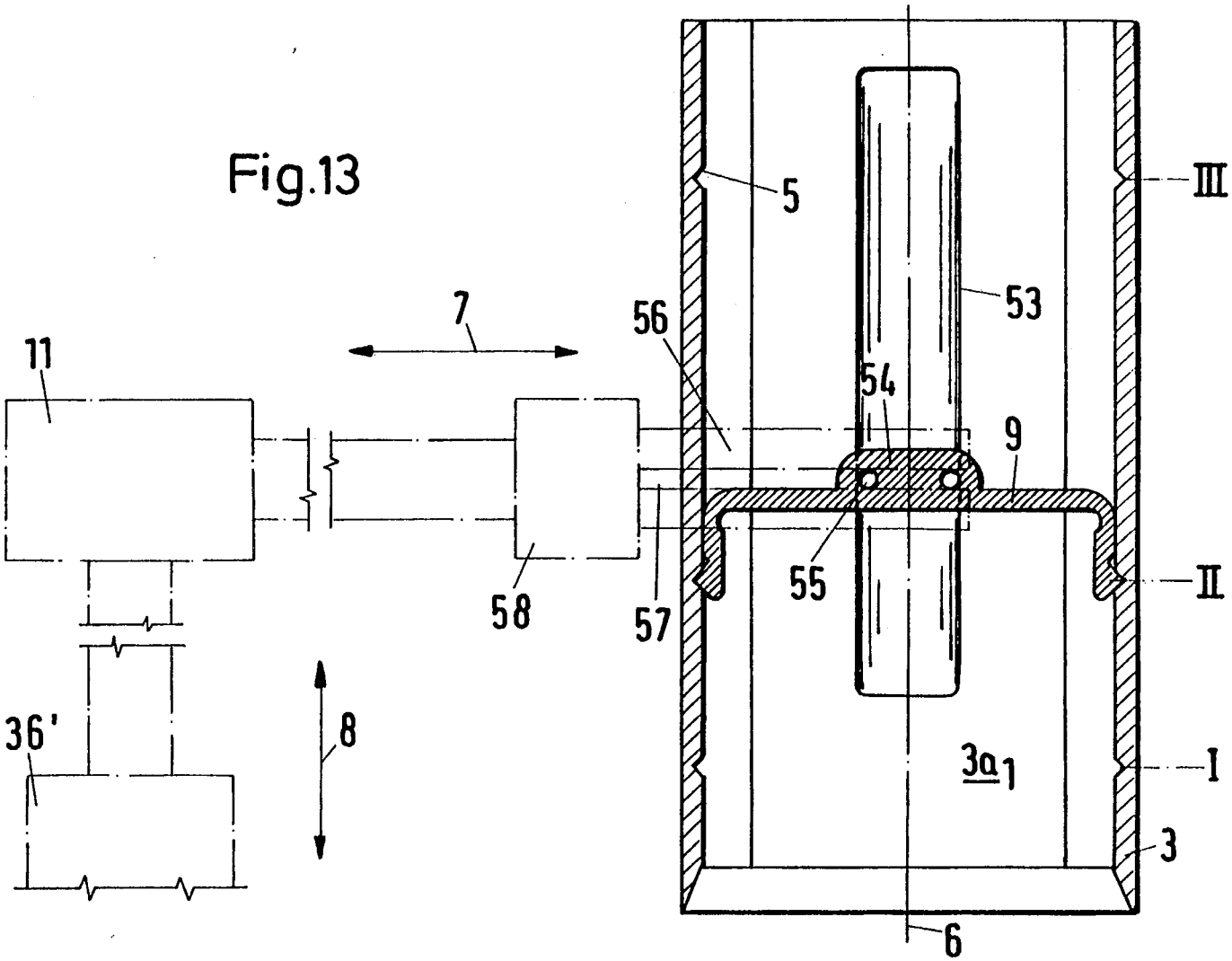
Figure 14:
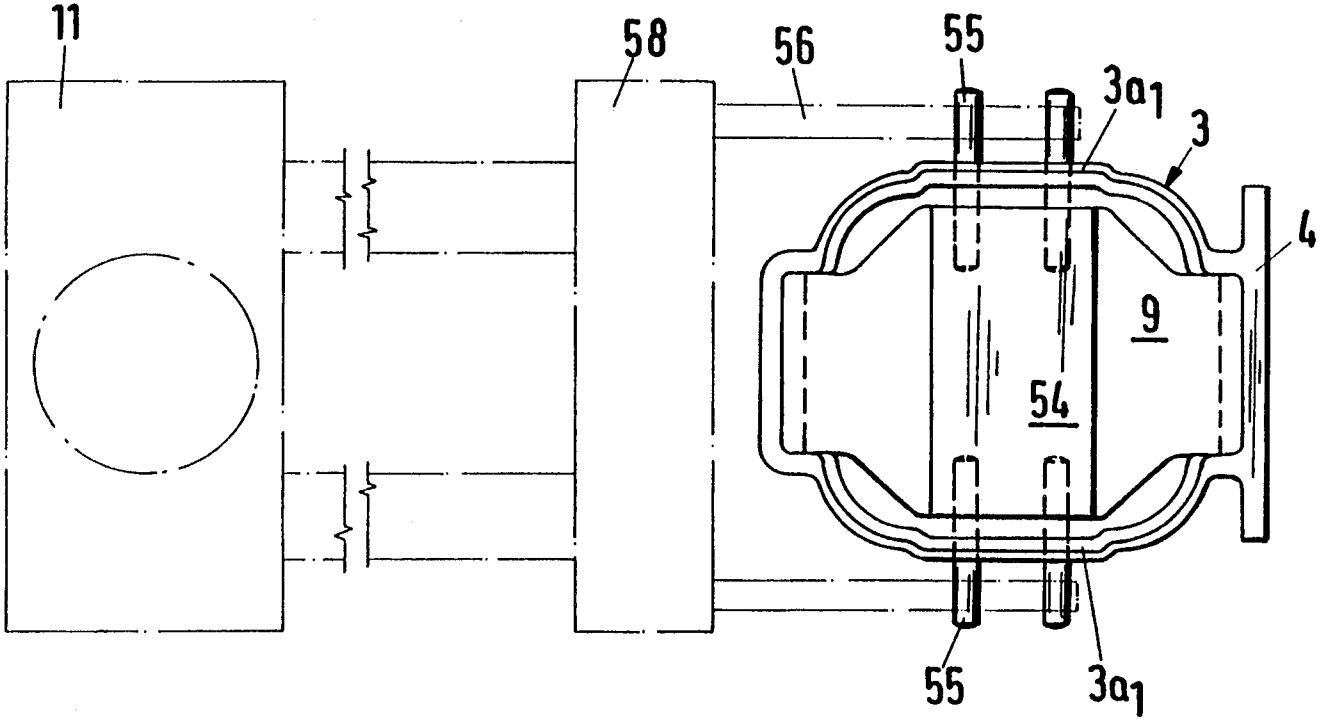

FIG. 7 et sequ. show from the second vertical group a first embodiment in cross-section;

FIG. 8 is a plan view of the embodiment in FIG. 7, from above;

FIG. 9 shows an alternative embodiment in a similar side view as in FIG. 7;

FIG. 10 is a plan view of the embodiment in FIG. 9 in section through the recesses in the workpiece carrier;

FIG. 11 shows a similar cross-sectional view of another and further embodiment with bar springs;

FIG. 12 is a plan view of the embodiment in FIG. 11;

FIG. 13 again shows another embodiment with the gripper system using bifurcated members and pins, and FIG. 14 is a plan view of the embodiment shown in FIG. 13.

Similar parts in the various embodiments are identified by the same reference numerals, which is why not all parts in all embodiments and drawings are provided with the same reference numerals.

Figure 1:
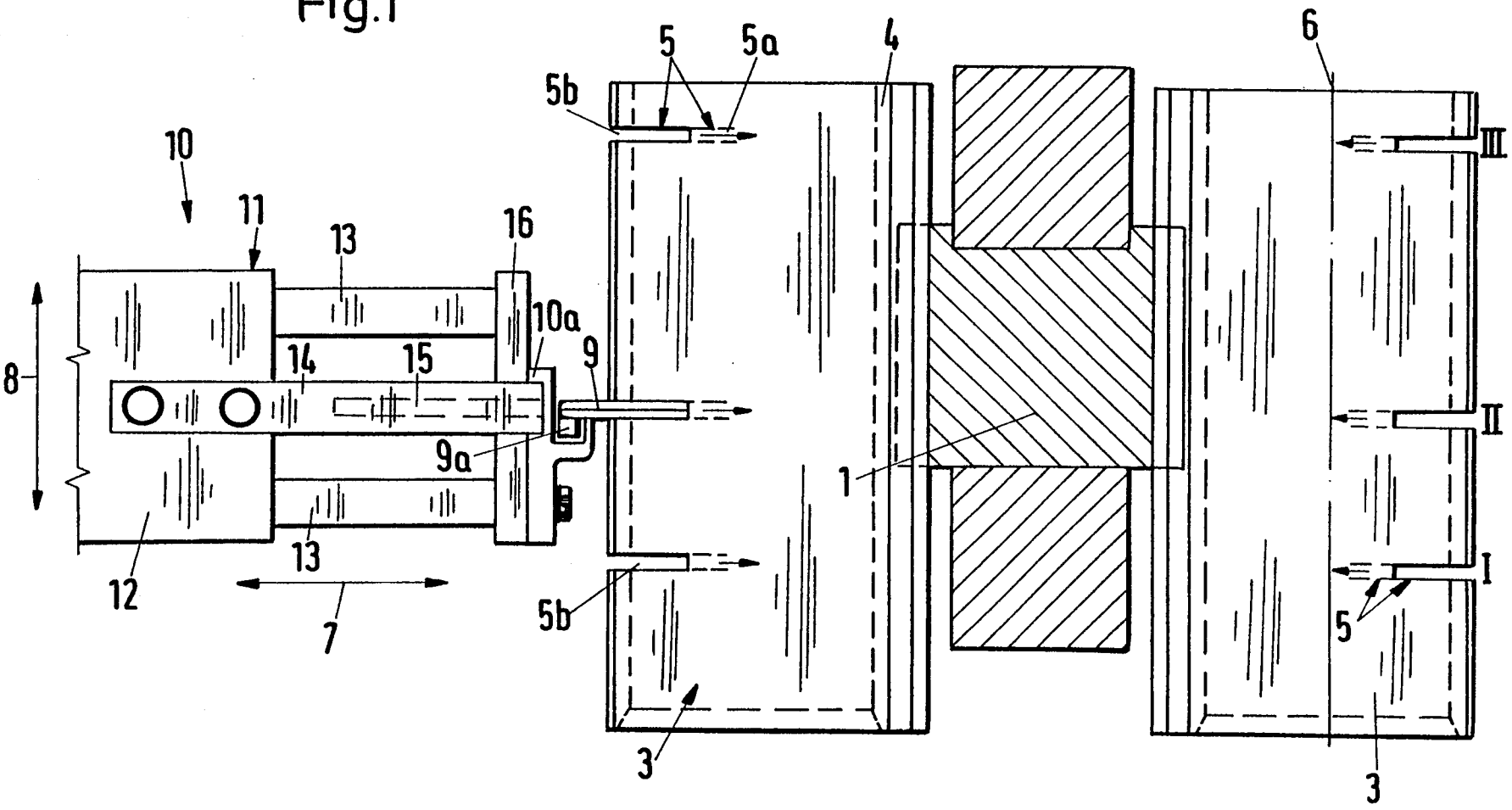
FIG. 1 is a diagrammatic and partially sectional side view of a first embodiment of the invention.
Figure 2:
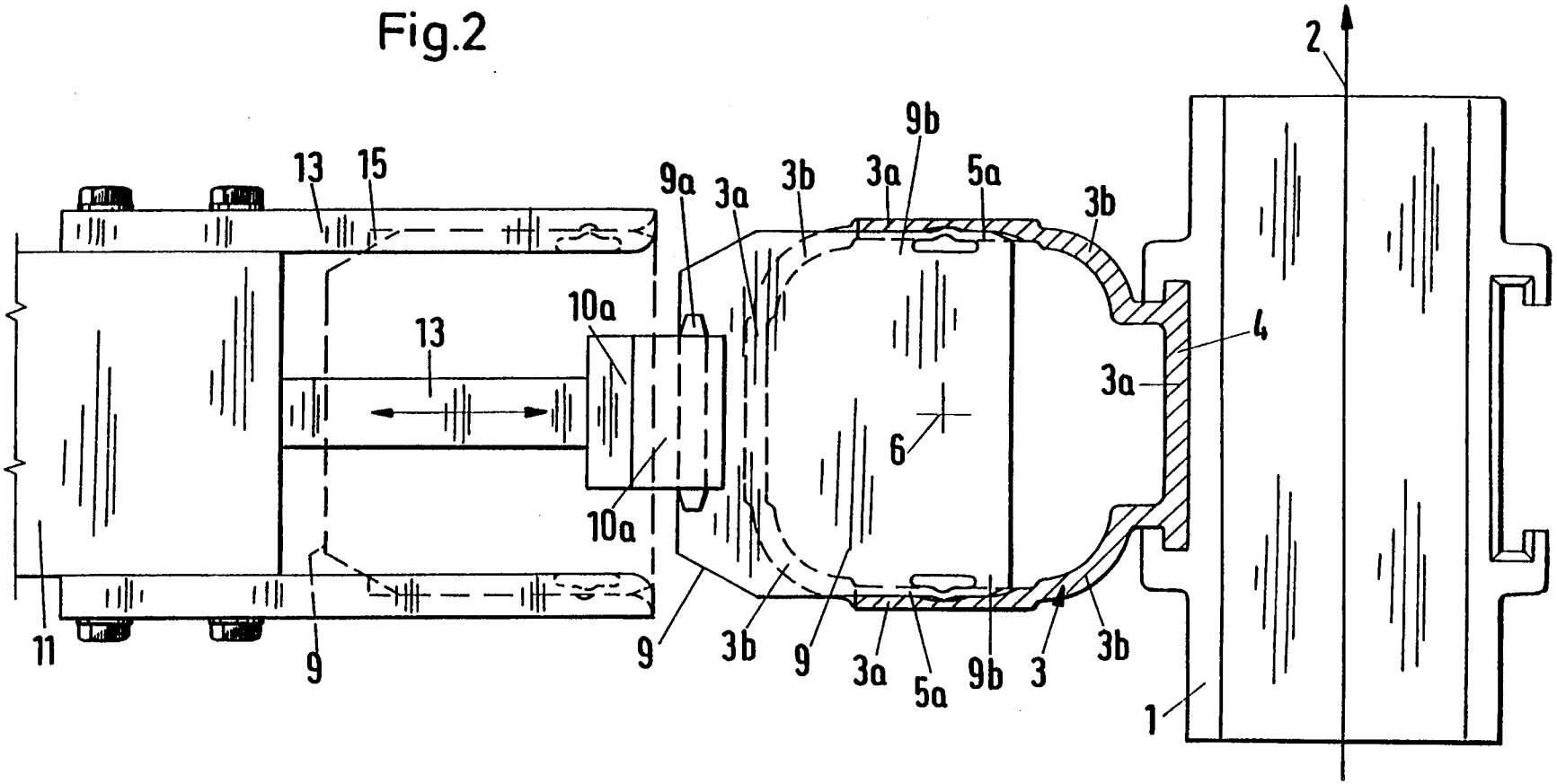
FIG. 2 is plan view of this embodiment.

The first so-called horizontal group of preferred embodiments referred to here are shown in FIGS. 1 to 6. On the member generally designated 1 of a conveyor line consisting of a plurality of members and moving in the direction of conveyance 2 (as illustrated in FIG. 1, for example on both sides), there is a workpiece carrier 3. It is of rectangular cross-section with rounded corners. Shown here are four straight portions 3*a* which are connected via quarter-circular rounded portions 3*b*. Disposed on the outside is a plane side wall 4 which is identical to one of the four straight portions 3*a*, although it is admittedly extended somewhat outwardly from the overall cross-section in order to provide a better facility for attachment of the workpiece carrier 3 to the line member 1. FIGS. 1 and 2 also show the recesses provided on the inner surface of the workpiece carrier and which are generally designated 5 and which in this first embodiment are constructed as pairwisely opposite parallel straight grooves 5*a*, although the outer wall also has to comprise completely traversing slots 5*b* in alignment with these grooves 5*a*. In the view shown in FIG. 2, these are situated in the region of the two left-hand portions 3*b* shown in broken lines along with the straight portion 3*a* of the workpiece carrier 3.

The longitudinal central axis of the workpiece carrier 3 is designated 6 and is set at right-angles to the direction of conveyance 2 of the line and thus also of the workpiece carriers 3 but, is also at right-angles to the so-called horizontal direction of movement 7 which is indicated in FIG. 1 by the straight double-headed arrow at the bottom. It will be understood that at various heights in the direction of the longitudinal central axis 6, the recesses 5*a*, 5*b* have to be disposed at a distance from one another in order to determine the desired adjustment positions. Here, it is assumed that the top of the extruded sleeve of the workpiece carrier 3 is at the bottom in FIG. 1 so that from this side the package can be imagined as extending vertically upward in the direction of the double-headed arrow 8, either to position I for minimum volume or to position II above it for medium volume or to the upper position III for the maximum volume of the workpiece carrier 3. In the case of this first and also in the case of the next two embodiments (FIGS. 3 and 4), the abutment member used is a bottom plate 9 having a cross-sectionally L-shaped gripper edge 9*a* to establish a point of attachment for gripper claws 10*a*, so that horizontal movement in the direction of the double-headed arrow 7 is made possible for the bottom plate 9.

Particularly in accordance with the view in FIG. 2, the edge 9*b* of the bottom plate 9 becomes engaged with the recesses 5 on the workpiece carrier 3 in that the bottom plate 9 is pushed horizontally into or is withdrawn from these grooves 5*a*. It is not necessary for the bottom plate 9 to disappear so completely into the interior of the workpiece carrier 3 that it does not project outwardly through the apertures 5*b*. The abutment function for the package which has to be prevented from falling through is also achieved completely upon partial insertion and stoppage.

The adjusting device designated 10 is intended to make it possible for the bottom plate 9 to be removed for instance from position II horizontally leftwards in the direction of the arrow 7 so that it is entirely free from the workpiece carrier 3. Then it must be moved in a vertical direction as indicated by the double-headed arrow 8, for example upwardly or downwardly and into position III or I and then again pushed to the right horizontally in the direction of the arrow 7 into the next recess 5.

This pattern of movements is achieved by the adjusting device 10 in that the adjusting means 10 comprises a lifting member not shown in FIGS. 1 and 2 and a sliding member 11 with retaining bodies 12 and two vertically superposed guide rods 13 as well as externally mounted guide strips 14 in which there are notches 15. At the front end there is an end plate 16 on which the gripper hook 10*a* is mounted.

Operation is as follows: the line member moves continuously as shown in FIG. 2 in the direction of conveyance 2 from the bottom upwardly and in accordance with FIG. 1, corresponding to the direction in which the plane of the paper is viewed. During this stage, the workpiece carrier 3 with the pushed-in bottom plate 9 moves so that its gripper edge 9*a* engages the gripper hook 10*a* and stops at a specific point in time due to the intermittent operation of the line. At this moment, the guide rods 13 are actuated and in the minimum of time withdraw the bottom plate 9 from the slot 5 in the workpiece carrier 3 and push it into the notches 15 in the guide strip 14. The bottom plate 9 is now in the left-hand position shown by broken lines in FIG. 2. The gripper hook 10*a* is disposed entirely on the left directly adjacent the retaining body 12. The guide rods 13 are pulled to the left virtually into the retaining body 12. The bottom plate 9 is withdrawn from the position II and is now to be moved to position III. For this, the retaining body 12 together with the guide strips 14 and the bottom plate 9 is moved vertically in the direction 8 and upwardly during which time also the drawn-in guide rods 13 and the end plate 16 with gripper hooks 10*a* are entrained. When position III is reached, once again a control arrangement is engaged which pushes the guide rods 13 rightwardly in the direction of the arrow 7 so that the bottom plate 9 is pushed into the workpiece carrier 3 by means of the gripper hook 10*a*. The retaining body 12 can remain in this position III and transport in the direction 2 by the line members 1 can continue. This change over is very time-saving so that shut down of the line members 1 requires only very little time. This minimal period of time can determine the cadence of a package producing machine.

Figure 3:
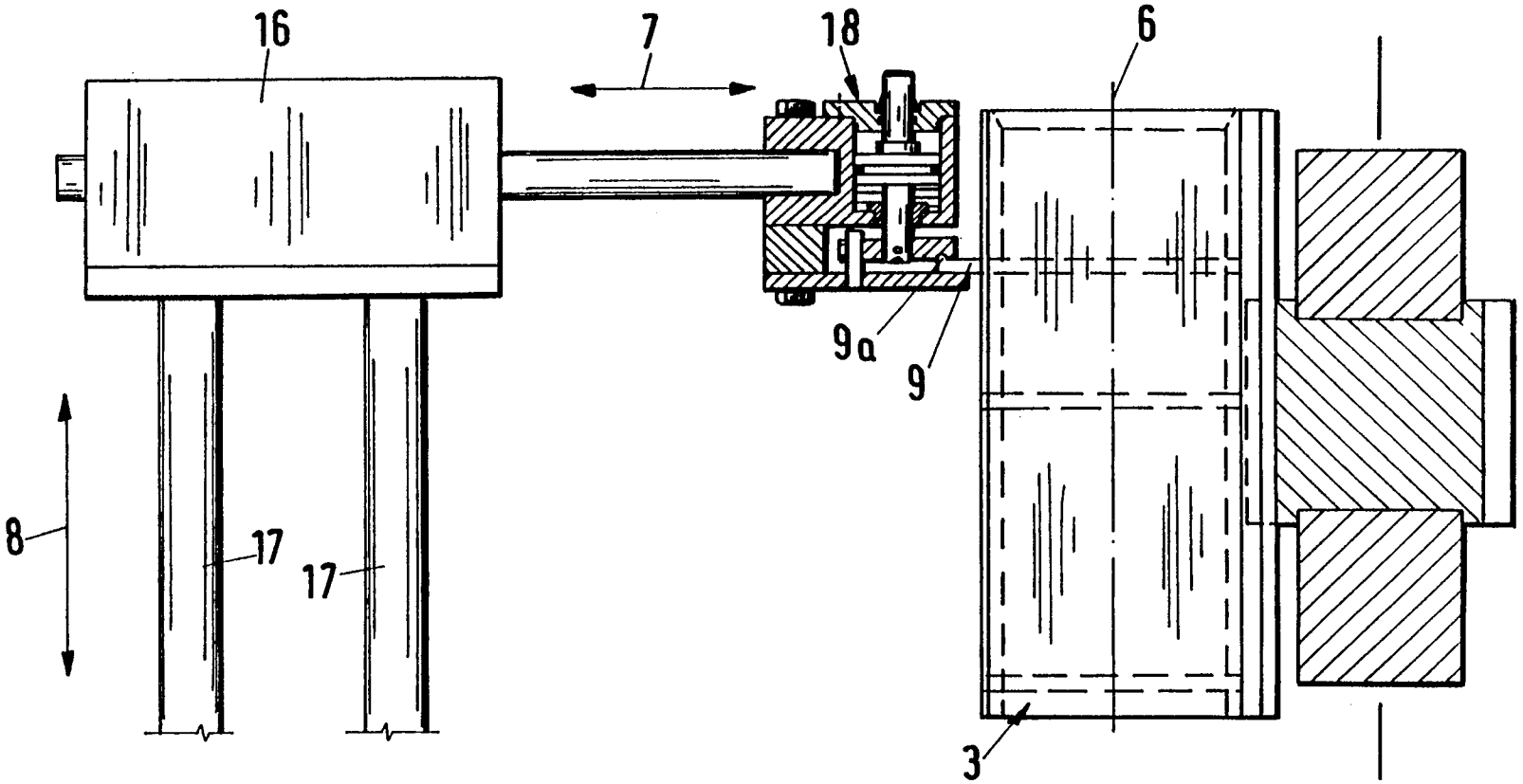
FIG. 3 is the same side view as in FIG. 1 but in the case of another and second embodiment.
Figure 4:
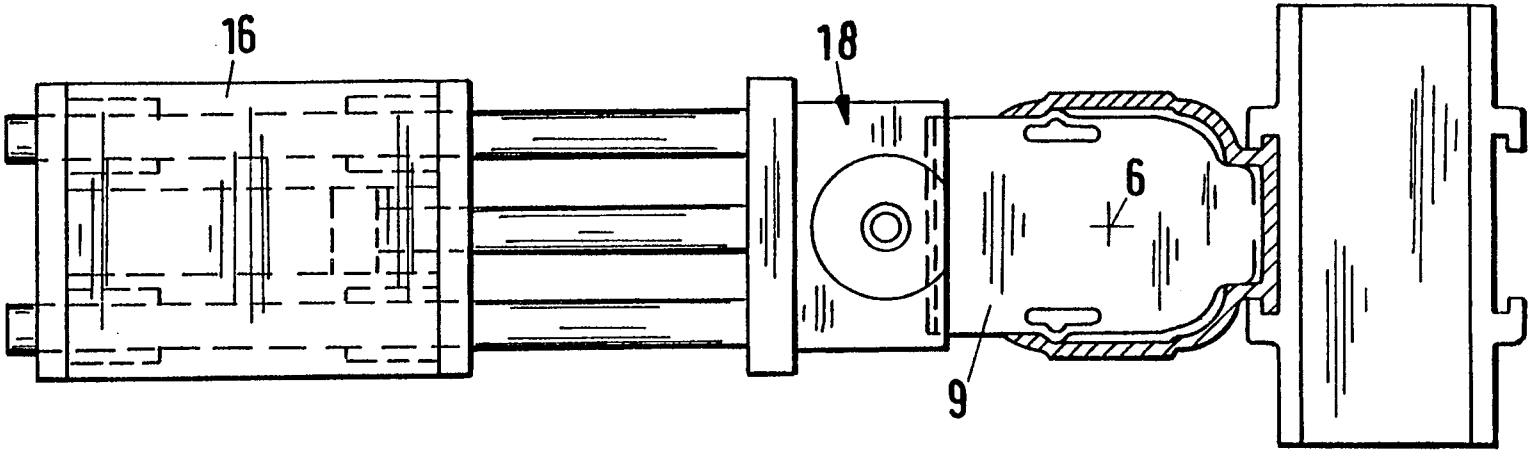
FIG. 4 is a plan view of the embodiment shown in FIG. 1.

The second embodiment is shown in FIGS. 3 and 4.

Here, too, the movements of the workpiece carriers and of the line members are the same as with the first embodiment and the abutment member which is constructed as a bottom plate 7 is withdrawn horizontally from the workpiece carrier 3 in the direction of the double-headed arrow 7 or is pushed into this latter and the vertical movement according to the double-headed arrow 8 is provided for by displacement to different heights in the direction of the longitudinal central axis 6. The sliding drive 16 is moved along the columns 17 in the direction of the double-headed arrow 8 with a translatory reciprocating movement and for its part it moves the gripper 18 in a horizontal direction as indicated by the double-headed arrow 7.

Instead of the gripper hook 10*a* in the case of the previously described embodiment with the guide strips 13, it is possible to omit the guide strips 13 and instead to use a gripper arrangement such as the gripper designated 13 in the case of the second embodiment and which is commercially available. Also other versions of gripper are obtainable. Where these arrangements are concerned, an opening or the edge 9*a* of the bottom plate 9 can be gripped by frictional closure or by form-locking closure and clamped fast. The gripper can achieve the same engagement also with any other embodiment, not shown, via an aperture. When the bottom plate 9 has first been clamped securely in the gripper 18, then the horizontal removal or vertical displacement or reinsertion in a horizontal direction can take place in a manner similar to that described with regard to the preceding embodiment.

The third and last embodiment from the horizontal group is explained with reference to FIGS. 5 and 6. Here, the abutment member is constructed as a switching pin 9*b* which can be horizontally inserted into and withdrawn from the interior of the workpiece carrier. Disposed at a vertical distance in the direction of the longitudinal central axis 6 of the workpiece carrier 3 are two switching pins 9*b* which together with the abutment edge 19 at the end of the workpiece carrier 3 determine the possibility of adjustment to three different positions.

Figure 5:
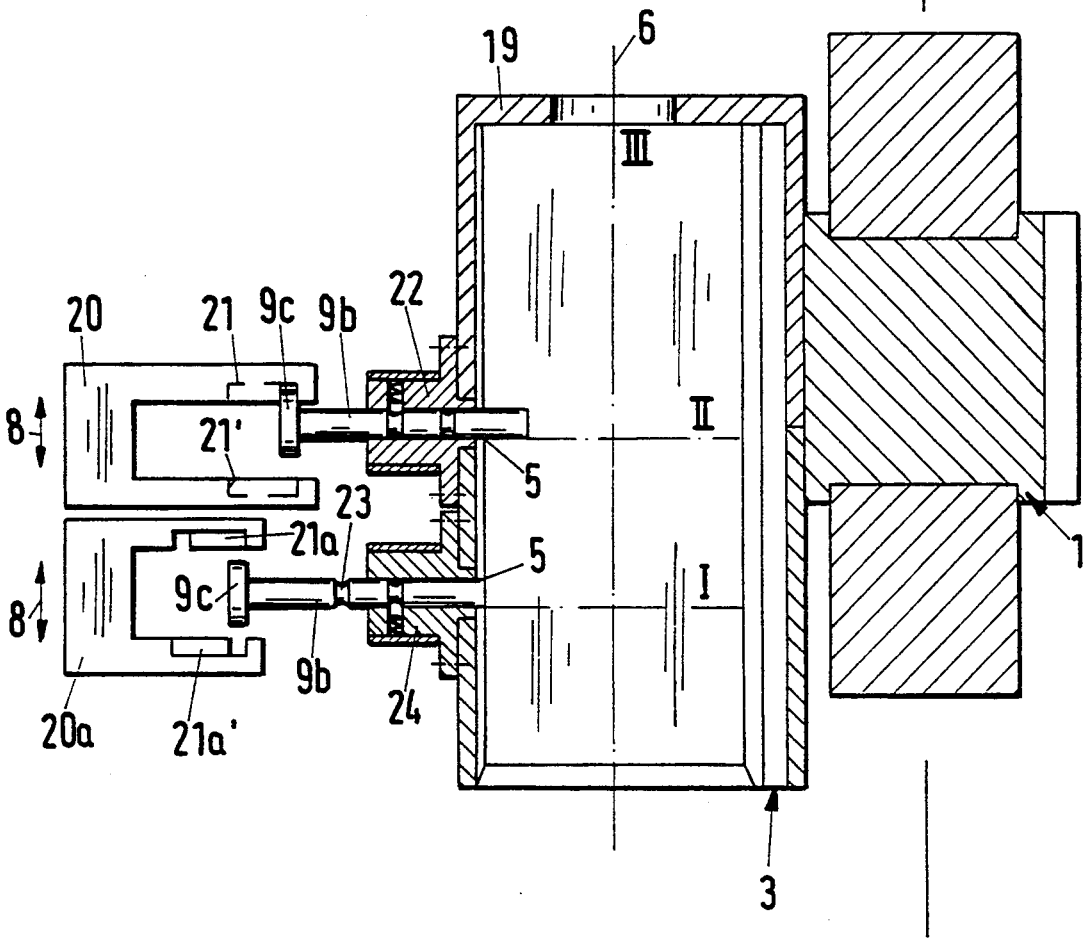
FIG. 5 is a further third embodiment in a side view similar to FIGS. 1 and 32.

Without using a bottom plate, it is possible in fact for the package, not shown, to be pushed from the completely open side of the workpiece carrier 3, from the bottom upwardly in FIG. 5, sufficiently that the (in the direction of pushing) leading edge of the package abuts the first switching pin 9*b* and is retained thereby in a precise position. Once the switching pin 9*b* shown in FIG. 5 has been fully extended (as is not shown in FIG. 5), the package can only be retracted into the workpiece carrier 3 by the shortest length, namely as far as position I. It is immaterial what position the upper of the two switching pins 9*b* shown in FIG. 5 assumes. On the other hand, if according to FIG. 5 the bottom switching pin 9*b* is retracted, while the upper switching pin remains in a position in which it projects into the interior of the workpiece carrier 3, then the package is able to reach position II. The workpiece carrier 3 is adjusted to its maximum holding capacity when both switching pins 9*b* are retracted so that the package can then be pushed upwardly as far as the abutment edge 19 so that it reaches the position designated III in FIG. 5.

An upper controlling member 20 and a lower controlling member 20*a* are adapted for vertical movement only in the direction of the double-headed arrow 8 and are in vertical cross-section of U-shaped construction as illustrated in FIG. 5, each arm of the U having in its end portion on mutually opposite sides a control cam 21, 21' or the bottom control member 20*a* has control cams 21*a* (the upper) or 21*a'*. The two arms of the U of the relevant control member 20, 20*a* are situated so far apart that outer abutments 9*c* of the switching pins 9*b* are able to move horizontally into and again out of the space between the arms of the U-shaped control member 20, 20*a* without engagement.

FIG. 5 shows the bottom control member 20*a* in the inoperative position, i.e. in which the outer abutment 9*c* of the switching pin 9*b* is not engaged with the control cam 21*a* or 21*a'*. On the other hand, where the upper control member 20 is concerned, an engagement of the outer abutment 9*c* with the upper control cam 21 is shown. This engagement has taken place in that the upper control body 20 has been moved a little farther downwardly in the direction of the double-headed arrow 8. This takes place by a control arrangement which is triggered for example by photoelectric cell scanning.

Figure 6:
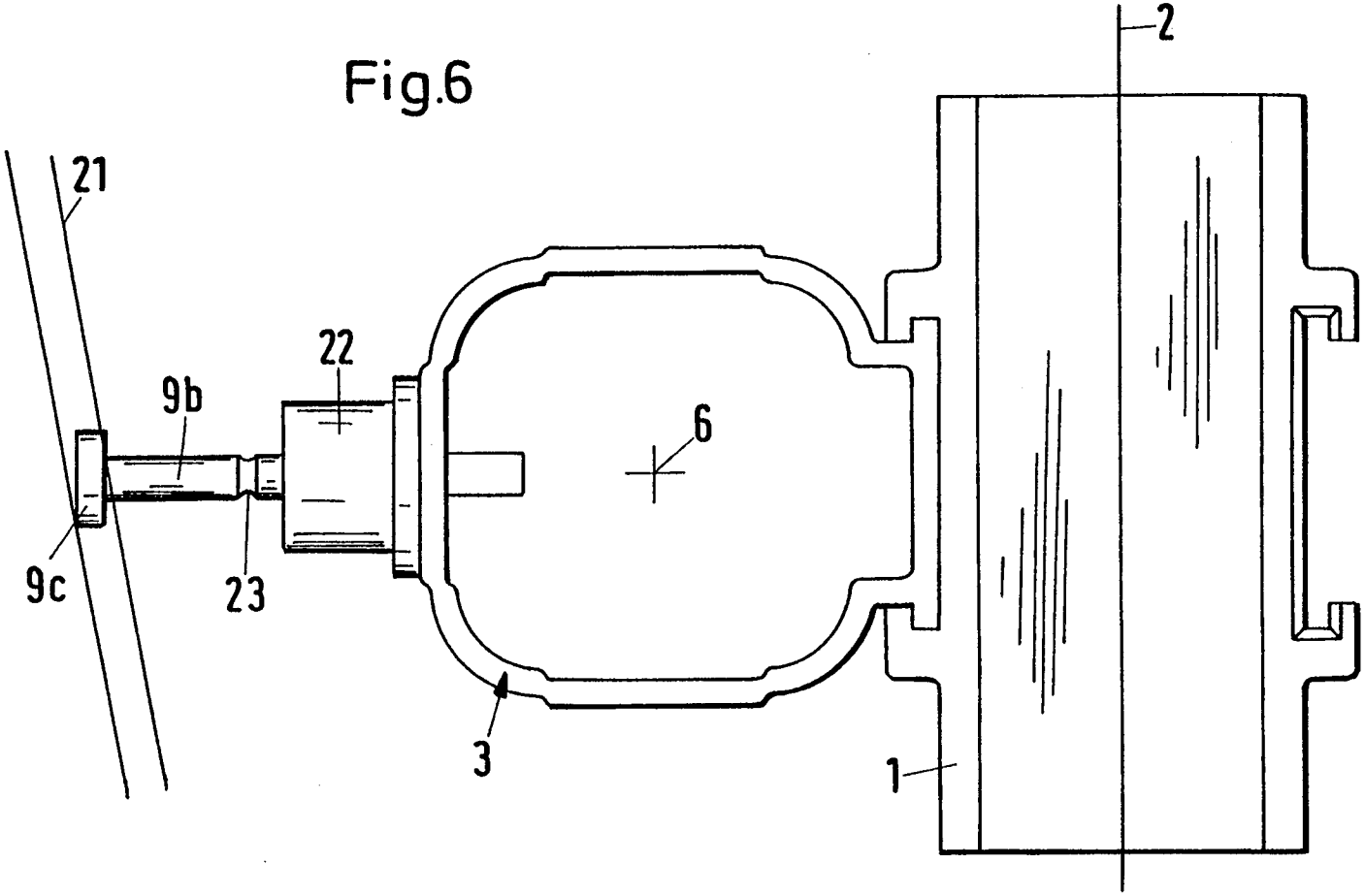
FIG. 6 is a plan view of the embodiment in FIG. 5.

In a plan view of the arrangement in FIG. 5 it is possible to see the illustration in FIG. 6, but in this case the control bodies 20, 20*a* are omitted and for better illustration of the invention only the upper control cam 21 itself is shown together with its engagement with the outer abutment 9*c*. FIG. 6 clearly shows that for a rectilinear construction of the control cam 21, the switching pin 9*b* is adapted o move for outwards or inwards movement in that the direction of the control cam 21 encloses an angle to the direction of conveyance 2, e.g. an angle of 5 to 40° and preferably 10 to 30°. If the workpiece carrier 3 according to FIG. 4 moves upwardly in the direction of conveyance 2, then the switching pin 9*b* is obviously extracted horizontally leftwardly out of the workpiece carrier 3 and vice versa.

The switching pins 9*b* are displaceably mounted in pin guides 22 which are rigidly mounted on the workpiece carrier 3. Each switching pin 9*b* has two locking notches 23 which can engage a resilientty pretensioned ball 24 in the pin guide 22.

Partial operation occurs for example in order to adjust to the maximum capacity, as follows. From the illustration in FIG. 5, also the upper switching pin 9*b* must be pulled out leftwardly. If, then, the line member 1 is moved in the direction of conveyance 2 (upwardly in FIG. 6), then in the view shown in FIG. 5 this means that the member 1 in the direction of view of the plane of the drawing, the member 1 moves away therefrom. During the course of this movement, the upper switching pin 9*b* is pulled out leftwards horizontally by its engagement with the control cam 21. The locking force of the upper locking ball 24 is overcome and the switching pin 9*b* is moved leftwardly sufficiently that the locking ball 24 so engages the second notch 23 in the upper switching pin 9*b* (the right-hand locking notch). This takes place at the moment when the right-hand front face of the switching pin 9*b* which is opposite the outer abutment 9*c*, is flush with the inner lateral wall of the workpiece carrier 3 and is withdrawn from the interior of the workpiece carrier. During this time, nothing changes in respect of the bottom switching pin 9*b*. When the package is then pushed into the workpiece carrier 3 from below, it firstly abuts the position III. Conversion to maximum capacity is concluded. It will be understood that this process is dependent upon the movement of the member 1. Advantageous in the case of this embodiment is the fact that the conversion from one capacity to the other takes place automatically upon onwards transport of the conveyor member 1.

During normal operation, when it is not intended to change the capacity, the controlling bodies 20, 20*a* and thus the control cams 21, 21'; 21*a*, 21*a*' are disengaged from the switching pins 9*b*. These project from the pin guides 22 as shown in FIG. 5 leftwardly. Once the aforedescribed change over has taken place, then the control cam must move into an analogous inoperative position of rest as shown in FIG. 5 when the bottom control body 20*a* is moved upwardly in accordance with the double-headed arrow 8. Then all the switching pins 9*b* pass the control bodies 20, 20*a* without making contact. The photoelectric cell scanning ensures that the control bodies and the switching pins are in each case correctly positioned.

The intention now is to describe hereinafter the vertical group of embodiments.

The first embodiment belonging to this group is shown in FIGS. 7 and 8. Here again is shown the workpiece carrier 3 the cross-section of which comprises two pairs of oppositely disposed straight portions 3*a* and four quarter-circular rounded portions 3*b* which connect the straight portions 3*a* to one another. In the case of this embodiment, what is more significant is the quarter-circular rounded portions 3*b* because corresponding shaped package bears on these while the straight portions 3*a* are radially offset outwardly in respect of the surface of the workpiece. Particularly markedly offset, forming pockets 25, are the two portions which are horizontally opposite each other in FIG. 8, and which are radially outwardly offset. In the case of this particular embodiment, the recesses 5 which are constructed as notches and which are on the inner surface of the workpiece carrier 3 are only formed in the region of the straight portions 3*a* of the workpiece carrier, which in each case forms the pocket 25. Certainly also in the region of the two straight portions 3*a* of the workpiece carrier cross-section which are offset by 90° in relation to the pockets 25, additional notches 5 can be provided if the abutment member which is in turn constructed as a bottom plate 9, does not prove to be sufficiently rigidly lockable by means of the notches 5.

In this and in the subsequent embodiments of vertical group, the bottom plate 9 is moved from a position I into whichever is the nearer position II or III and vice versa, just by moving in a vertical direction, i.e. in the direction of the longitudinal central axis 6 through the workpiece carrier 3.

This displacement of the bottom plate 9 within the workpiece carrier 3 is possible because on the two mutually opposite edges 9*d* of the bottom plate 9 which are of resiliently flexible construction, there are correspondingly radially flexible movable projections 9*e* which are rectilinear in this embodiment.

The bottom plate 9 is preferably manufactured from a resilient synthetic plastics material so that also its outer edges 9*d* are resiliently flexible. The bottom plate may however also consist of a combination of materials, e.g. a relatively rigid main part of disc or plate shape in the region of the middle of the bottom plate 9 on which the outwardly and downwardly projecting marginal portions 9*d* are so fixed that the U-shaped form shown in vertical cross-section in FIG. 7 results. For example, a leaf spring could be riveted onto a rigid central disc at the front and rear. Alternatively, also an injection moulded spring part could be provided in a synthetic plastics bottom plate.

In the case of the embodiment being described here and which is shown in FIG. 7 and 8, FIG. 8 shows the elongated form of the bottom plate 9 which has projections 9*e* constructed as catches disposed on the two straight edges 9*d* which project into the pockets 25. They are situated on the straight part of the edge 9*d* of the bottom plate 9.

The vertical movement of the bottom plate 9 takes place by means of an adjusting device which has a gripper system which can be connected to the bottom plate 9 and which is generally designated 18*a* in FIG. 7.

Here, a clamping head 26 comprises an upper piston rod 27 with a flattened end 28 which is rotatable for example in the direction of the curve arrow 29 in FIG. 8 about the longitudinal central axis 6 which is also the central axis of the clamping head 26.

In operation, the clamping head 26, together with the piston 30 which is rigid in relation to it, moves as one unit axially and vertically as indicated in FIG. 7 from the bottom upwardly in the direction of the longitudinal central axis 6 through the workpiece carrier 3 in such a way that the outwardly and upwardly axially projecting piston rod end 28 is in the correct rotary position when it passes through the elongated hole 31 in the bottom plate 9 so that it assumes the position shown by broken lines in FIG. 7, where it stops. Compressed air is now passed through the line 34 in the direction of the arrow 35 upwardly behind the piston 30 so that the piston rod 27 moves downwardly. By reason of a spiral groove 36 provided in the piston rod 27, there is at the same time a rotation in the direction of the curved arrow 29 in FIG. 8 so that now the flattened piston rod end 28 moves out of the higher position (shown by broken lines in FIG. 7) into the transverse position shown by solid lines in FIGS. 7 and 8 and bears on the bottom plate 9. Piston 30 and piston rod 27 now remain stationary in relation to the clamping head 26. A positioning transmission or the like, not shown, now pushes the clamping head 26 so that it can perform the vertical displacement movement out of the midway position shown in FIG. 7 into the upper or lower position. Then, compressed air is passed through the line 32 from below in the direction of the arrow 33 behind the under side of the piston 30 so that the piston rod 27 moves upwards again, rotating, and the flattened piston rod end reaches the position shown by the broken lines. In this position, the entire clamping head 26 is able to be extended vertically downwardly so that the bottom plate 9 is then located by itself in the new desired position without the clamping head 26, in which position the straight projections 9*e* which are constructed as catches are locked in the relevant recesses 5 in the workpiece carrier 3.

As an alternative which is not shown in the drawings it is possible instead of the rotation of the piston rod end 28 also to use an expanding mandrel after the fashion of a beer bottle stopper. For example, an expanding mandrel with a rubber element can be used. By axial compression of the rubber ring, then, this rubber ring becomes radially outwardly pressed.

The second embodiment of the vertical group is shown in FIGS. 9 and 10. For vertical movement, a lifting cylinder 36 is shown on which a rotary cylinder 37 is fixed for performing a rotary movement. Seated on this is the clamping head 26 which is of similar construction to that described in connection with FIGS. 7 and 8. Screwed onto an outer housing 38 of the clamping head 36 is a metal driver plate 39 which has, two radially oppositely disposed entraining pins 40. Shown in the centre here, as a piston rod end, is a rubber expanding mandrel 28'.

The bottom plate 9 shown in FIG. 10 is rectangular with rounded corners and with two oppositely disposed holes 41 (which must not be confused with the large holes 32 in the region of the corners). The entraining pins 40 project into these holes 41, so that the bottom plate 9 can be rotationally rigidly seated on the metal plate 39 of the clamping head 26.

FIG. 10 shows how, when they are in the diagonal position, tilted through 45°, the rounded corners are pushed into notches 43 in the workpiece carrier 3.

In operation, the rotary cylinder 37 is moved upwardly into the bottom plate 9 with the help of the cylinder 36 together with the clamping head 26 and the housing 38 and also the fitted driver 39 when the intention is to move the bottom plate 9 into the bottom position I for example. Rotating the above-described drive in the clamping head 26 so tensions the rubber mandrel 28' that its outside diameter is increased and consequently the bottom plate 9 is securely clamped. Then the rotary cylinder 27 turns in the direction of the curved arrow 44 (FIG. 10) through 45° and the rounded corners of the bottom plate 9 become disengaged from the notches 43 in the workpiece carrier 3. The bottom plate 9 is then capable of free upwards and downwards movement axially in the workpiece carrier 3, i.e. vertically in FIG. 9, in the direction of the longitudinal central axis 6 of the workpiece carrier. The rotary cylinder 37 stops its rotary movement and the lifting cylinder 36 now commences a movement downwards according to FIG. 9 so that the bottom plate 9 is moved into the position I. There, the lifting cylinder 36 stops. The rotary cylinder 37 again turns the bottom plate 9 in the direction of the curved arrow 44 through 45°. Consequently, via the entraining pins 40 and against frictional resistance, the relevant corner is pushed into the notch 43 in the workpiece carrier 3. Afterwards, the rubber mandrel 28' is relaxed and with the lifting cylinder 36 the entire adjusting means 36 to 40 is withdrawn. The bottom plate 9 is now in the desired new position I.

Should the commercially available rotary cylinder 37 not be capable of being further rotated through 45 or 90°, then also other embodiments can be used where the bottom plate 9 can be rotated once in the direction of the curved arrow 44 and once in the opposite direction.

A further preferred embodiment from the vertical group is described with reference to FIGS. 11 and 12. Here, the clamping head 26 shown in FIG. 11 comprises, in pairs, four oppositely disposed bar springs 45 which are pretensioned radially inwardly against the direction of the arrow 46. They are fixed in the clamping head 26 and project axially upwardly substantially parallel with the longitudinal central axis 6 in order to extend into holes 47 in the bottom plate 9.

FIG. 12 shows the shape of the bottom plate 9 which in plan view is substantially rectangular with rounded corners, the four holes 47 in tongues 48 being disposed at a distance from the corners. The tongues 48 are of radially resiliently flexible construction in that slots 49 extend a little from the edge of the bottom plate and arcuately into it. Extending from the radially outermost ends of the tongues 48 are projections 50 which have, constructed as bores, recesses 5 by which they engage the quarter-circular rounded portions 3*b* of the workpiece carrier 3. If all four tongues 48 are moved radially inwardly towards the centre, then the projections 50 can be withdrawn from the recesses 5 and the bottom plate 9 is free to perform vertical movement and thus displacement out of position II, for instance into position I. In the case of this embodiment according to FIGS. 11 and 12, the bottom plate 9 does not have the central bore 31 shown on the two preceding embodiments and the function of which is taken over here in the following way by the four holes 47°

The four round bar springs 47 shown in FIG. 11 are so pretensioned in the inserted bottom plate 9 that they exert a pressure inwardly against the direction of the arrow 46 and push the resilient tongues 48 of the bottom plate 9 radially inwardly to the centre (longitudinal central axis 6). Consequently, the projections 50 which must be regarded as locking pins, become disengaged from the notches, holes or other types of recess 5 in the workpiece carrier.

If, now, the piston 30 is moved upwardly, because compressed air is applied to the bottom of it as indicated by the arrow 33, then four radial pins 51 are pushed outwards through the cone 52 so that the locking pins 50 engage the recesses 5 in the workpiece carrier 3. The normal situation therefore is the one in which the piston 30 has been moved upwards, the round bar springs 45 continuing to press the tongues 48 outwardly.

On the other hand, if the conical end 52 with the piston 30 is moved downwards to relax it, then the radial pins 51 move inwardly and the bottom plate 9 becomes disengaged from the workpiece carrier 3. At this moment, the bottom plate 9 can be moved into the next position by means of the lifting cylinder 36, for instance as shown in FIG. 11 in which it moves vertically downwardly into position I. Once it has been so adjusted, the piston 30 is raised again so that the normal position is reached and the bottom plate 9 is locked in the workpiece carrier. In this standard position, once it has been attained, the clamping head 26 can then be moved out downwardly to disengage from the round bar springs 45. Thus, the bottom plate 9is completely disengaged from the lifting and rotating apparatus which can then be removed.

Very similar to the embodiment shown in FIGS. 7 and 8 is the last embodiment to be described here, and which is shown in FIGS. 13 and 14. Here, there is formed in each of the two oppositely disposed side walls $3a_1$ an elongated hole 53 which extends parallel with the longitudinal central axis 6 of the workpiece carrier 3. The bottom plate 9 is constructed very similarly to that in FIG. 7 except that here it is not the central hole 31 but a support 54 which is supplied for pins 55. These pins are disposed in pairs on radially opposite sides, as shown in FIG. 14. They project from the relevant edge of the bottom plate 9 out of the space within the workpiece carrier 3 through the elongated hole 53 and sufficiently outwards that horizontally extending forks 56, positioned U-wise, are able to accommodate these pins 5 in their slots 57 when they have been moved rightwardly in the direction of the double-headed arrow 7. A lifting member 36′ is able to move the sliding member 11 together with the support 58 for the forks 56 vertically upwardly or downwardly in the direction of the double-headed arrow 8 and into such a position that by way of the pins 55, the bottom plate 9 reaches the desired position II, I or III. Subsequently, the sliding member 11 draws the forks 56 leftwards by horizontal movement as indicated by the double-headed arrow 7 so that the bottom plate is freely disposed in the position and can be moved onwards by the line member 1 together with the workpiece carrier 3.

We claim:

1. An apparatus for adjusting the holding capacity of a workpiece carrier, the apparatus comprising a workpiece carrier in the form of a sleeve open at both ends and defining a central longitudinal axis, the workpiece carrier being adapted for support on a conveyor line and having at least one substantially plane side wall adapted to mounting adjacent to the conveyor line and extending substantially parallel with the conveyor line and with a direction of conveyance of the workpiece carrier, the workpiece carrier including at least one inner surface having recesses adapted for positioning of a workpiece in the workpiece carrier, wherein the recesses are disposed at a distance from one another in the direction of the longitudinal axis and are adapted to receive at least one movable abutment member.

2. An apparatus according to claim 1, wherein the abutment member comprises a plate having edges that are adapted for engagement with the recesses.

3. An apparatus according to any one of claims 1 and 2, further comprising at least one movement component adapted for releasable engagement with the abutment member, the movement component being adapted for movement at right angles to the direction of conveyance of the workpiece carrier and at right angles to the longitudinal axis, wherein the abutment member is adapted for penetration into the workpiece carrier.

4. An apparatus according to any one of claims 1 and 2, wherein the recesses are formed as straight parallel grooves disposed in pairs on opposing inner surfaces of the workpiece carrier, the abutment member comprising a plate that is removably receivable in the recesses and adapted for releasable engagement with an adjusting member disposed adjacent to the conveyor line.

5. An apparatus according to any one of claim s 1 and 2, further comprising adjusting means including a lifting member in driving engagement with a gripper member that is adapted for releasable engagement with the abutment member in a direction parallel with the longitudinal axis, and a sliding member adapted for engagement with the lifting member for moving the gripper member in a direction transverse to the longitudinal axis and transverse to the direction of conveyance of the workpiece carrier.

6. An apparatus according to claim 3, wherein the abutment members comprise at least two switching pins that are adapted for insertion into and withdrawal from an interior of the workpiece carrier through the recesses, the recesses comprising holes that completely traverse at least one wall of the workpiece carrier.

7. An apparatus according to claim 6, further comprising at least two separate control means adapted for reciprocating translatory movement independently of each other in a direction substantially parallel with the longitudinal axis, each of the control means comprising a cam adapted for engagement with an outer abutment portion of the switching pin.

8. An apparatus according to any one of claims 1 and 2, wherein the abutment member comprises a plate that is adapted for movement in the interior of the workpiece carrier in the direction of the longitudinal axis, and adjustment means are provided for engagement with and movement of the plate.

9. An apparatus according to claim 8, wherein the plate comprises at least two oppositely disposed flexible edges that are receivable in the recesses of the workpiece carrier.

10. An apparatus according to claim 8, wherein the adjustment means comprises a clamping head adapted for engagement with at least one hole disposed in the plate.

11. An apparatus according to claim 8, wherein the adjustment means comprises a bifurcated member adapted for movement outside of the workpiece carrier, and the plate comprises pins mounted thereon that are adapted for releasable engagement with the bifurcated member.

12. An apparatus according to claim 8, wherein the adjustment means comprises at least two mutually opposed and radially inwardly pretensioned bar springs extending substantially parallel with the longitudinal axis and adapted for engagement with at least two resilient tongues formed by slots located at the edge of the plate, the plate including at least one projection located on an outer edge of each tongue that is disengagably receivable in the recesses of the workpiece carrier.

13. An apparatus according to claim 8, wherein the adjustment means comprises a mandrel adapted for engagement with a central hole disposed in the plate.

14. An apparatus according to claim 8, wherein the workpiece carrier has a cross-section that is substantially rectangular with rounded corners, the recesses are disposed on at least two planar inner surfaces of the workpiece carrier, the plate is substantially rectangular with corners adapted for engagement in the recesses, and the adjustment means comprises a rotatable cylinder releasably engagable with the plate and adapted for rotating the plate to engage the corners of the plate in the recesses.

15. An apparatus according to any one of claims 1 and 2, wherein the workpiece carrier comprises a substantially circular cross-section.

16. An apparatus according to any one of claims 1 and 2, wherein the workpiece carrier comprises a cross-section having at least two oppositely disposed straight portions connected by rounded corners.

17. An apparatus according to claim 16, wherein two of the oppositely disposed straight portions include an elongated hole disposed therein extending in a direction substantially parallel with the longitudinal axis.

18. An apparatus according to any one of claims 1 and 2, wherein the apparatus is adapted for transporting tubular flowable media packages that are open at one end.

* * * * *